US006282723B1

(12) United States Patent
Villegas

(10) Patent No.: US 6,282,723 B1
(45) Date of Patent: Sep. 4, 2001

(54) SYMMETRICAL PLEATED SKIRT

(76) Inventor: Steven Jefferey Villegas, 309 N. 36th St., Apt. 8, Seattle, WA (US) 98103

( * ) Notice: Subject to any disclaimer, the term of this patent is extended or adjusted under 35 U.S.C. 154(b) by 0 days.

(21) Appl. No.: 09/710,093

(22) Filed: Nov. 10, 2000

(51) Int. Cl.[7] ..... A41D 1/14
(52) U.S. Cl. ..... 2/211; 2/74
(58) Field of Search ..... 2/211, 74, 75, 2/212, 213, 105, 226, 272, 48, 243.1, 67; D2/735, 736, 740, 741, 775, 776, 851, 852, 861

(56) References Cited

U.S. PATENT DOCUMENTS 2,398,537 * 4/1946 Koret ..... 2/211
4,662,008 * 5/1987 Weiser ..... 2/211
5,557,808 9/1996 Kawai .
5,566,393 * 10/1996 Best ..... 2/74
5,636,386 * 6/1997 Salamone ..... 2/211 X
5,771,494 * 6/1998 Ralston et al. ..... 2/211
6,029,279 * 2/2000 Ralston et al. ..... 2/211

* cited by examiner

*Primary Examiner*—Gloria M. Hale
(74) *Attorney, Agent, or Firm*—Christensen O'Connor Johnson Kindness PLLC

(57) ABSTRACT

A pleated garment is disclosed as including a front center pleat having at least two outward facing pleat lines, a back center pleat having at least two inward facing pleat lines; and a plurality of right and left pleats extending substantially from the front center pleat in opposite directions to the back center pleat.

16 Claims, 6 Drawing Sheets

SYMMETRICAL PLEATED SKIRT

FIELD OF THE INVENTION

This invention generally relates to a pleated garment such as skirts and, more specifically, to kilts.

BACKGROUND OF THE INVENTION

Pleated garment such as skirts and kilts have been manufactured and marketed commercially for many years. Where the garment is a kilt, the general construction consists of three basic parts. The over apron, which is the unpleated section on the front, the pleats or "lines" forming the back of the kilt, and the under apron, which is also unpleated and fits under the over apron. The kilt wraps around the wearer's waist and thighs, with the over apron opening on the wearer's right side.

The prior art kilts have a number of disadvantages for the wearer, however. Because they do not have pleats all the way around them, the prior art kilts do not allow for full leg motion and natural ventilation. Furthermore, due to the unidirectional orientation of the pleats, the wearer of the prior art kilt may "catch" or snag their kilt onto objects when walking, running, or otherwise engaging in physical activities. This frequently occurs in situations where the wearer ventures out into the outdoors and snags their kilts onto branches or twigs nearby.

Still further, the wearer's line of sight is often impeded by the kilt as the wearer walks or runs. This phenomenon is produced by the wearer "kicking up" the kilt during walking or running motions.

Therefore, in light of the above problems, there is a need for a kilt that allows full leg motion and natural ventilation for the wearer. There is an additional need for a kilt that does not "catch" or snag the wearer's kilt onto objects when walking, running, or otherwise engaging in physical activities. There is an additional need for a kilt that does not impede a wearer's line of sight when the wearer walks or runs.

SUMMARY OF THE INVENTION

According to one embodiment, a pleated garment is disclosed. The pleated garment including a front center pleat having at least two outward facing pleat lines, a back center pleat having at least two inward facing pleat lines; and a plurality of right and left pleats extending substantially from the front center pleat to the back center pleat.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention provides a symmetrical pleated kilt that allows the wearer full leg motion and natural ventilation. Furthermore, the symmetrical pleated kilt of the present invention does not "catch" or snag the wearer's kilt on objects as the wearer walks, runs, or is otherwise engaged in physical activities. Still further, the symmetrical pleated kilt does not impede a wearer's line of sight when the wearer engages in walking or running.

One preferred embodiment of a symmetrical pleated kilt according to the present invention will be described hereinafter with reference to the attached drawings.

Figure 1:
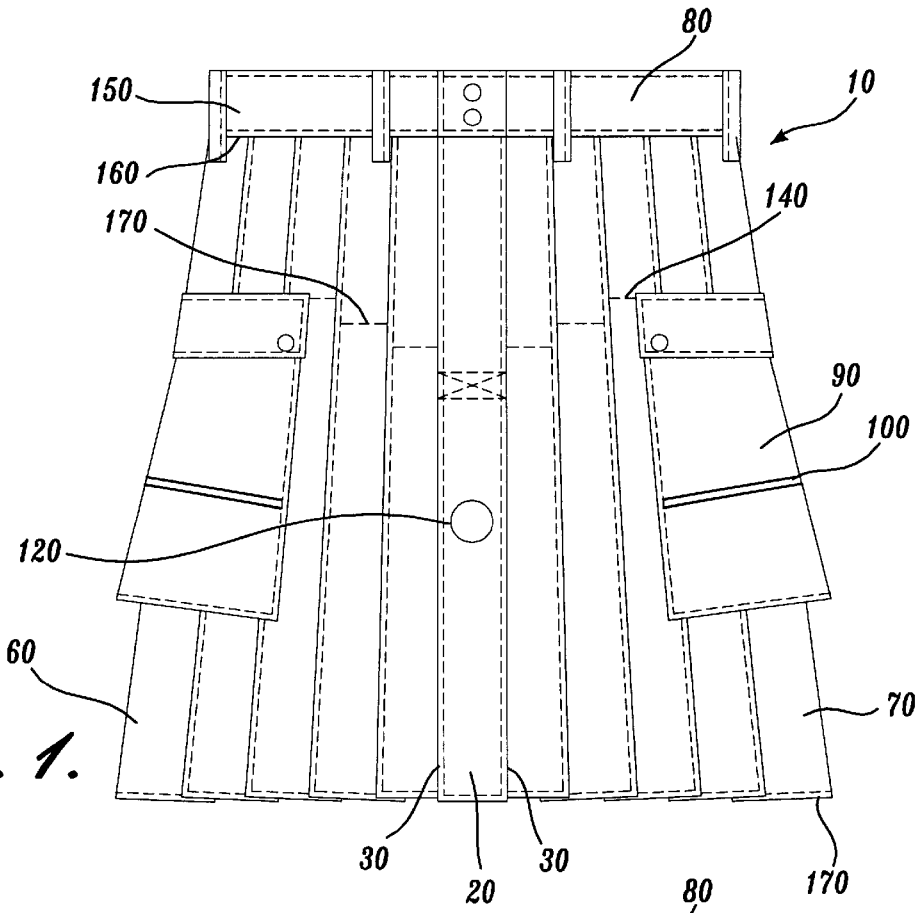
FIG. 1 is a front view showing a symmetrical pleated kilt according to one embodiment of the present invention.
Figure 2:
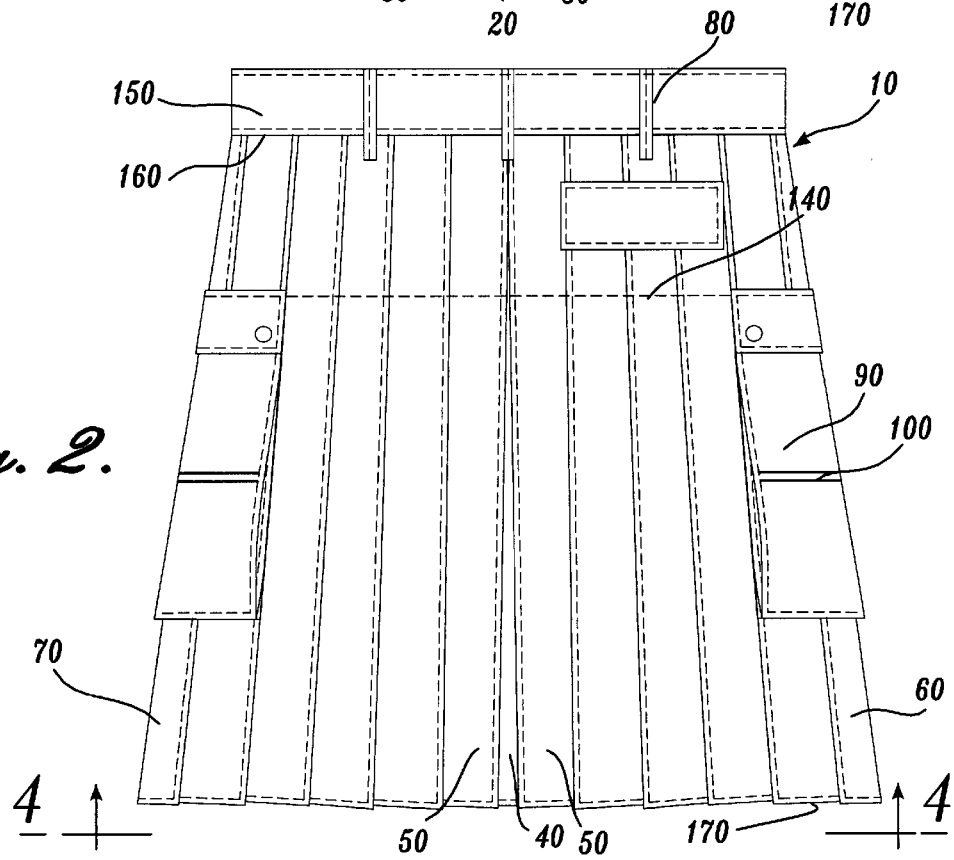
FIG. 2 is a back view showing a symmetrical pleated kilt according to one embodiment of the present invention.

FIG. 1 is a front view showing a symmetrical pleated kilt 10 according to one embodiment of the present invention. The back view of the symmetrical pleated kilt is shown in FIG. 2. A kilt normally has a plurality of pleats, which are made by folding the kilt cloth and pressing a sharp edge or by stitching together the folds of the cloth so that the fold or pleat lines extend across the length of cloth from the waistband to the sweep. Kilt 10 has a front center pleat 20 that has two or more outward facing pleat lines 30. Pleat lines are the sharp edges of the pleats when the pleats are finished and pressed, and will be visible from the outside of the kilt. Front center pleat 20 can have a pleat face width of about 2 inches and a return of about 1⅛ inches on one side thereof and ¾ inch on the other side thereof. The pleat face is the surface face of the pleat that is visible from the outside of the kilt. The under pleat or "return," as it is sometimes called, is the portion of the pleat that is joined by the pleat line to the pleat face and is normally tucked beneath the pleat face. Thus, the return is not typically visible from the outside of the kilt.

As shown in FIG. 2, kilt 10 also has a back center pleat 40 that has two or more inward facing pleat lines 50. In one embodiment, the width measured from one inward facing pleat line to the other inward facing pleat line of the back center pleat stretched out can be about 6 inches. A plurality of right 60 and left pleats 70 extend from the front center pleat 20 to the back center pleat 40. In accordance with one embodiment of the present invention, the plurality of right 60 and left pleats 70 extend symmetrically from the front center pleat 20 to the back center pleat 40. The width of the pleat face of one of the plurality of right and left pleats can be about 3½ inches and the return can be about 1½ inches. Applicant has found that this results in an effective use of material to form the pleats. However, only widths for the pleat faces and returns can be used.

Figure 3:
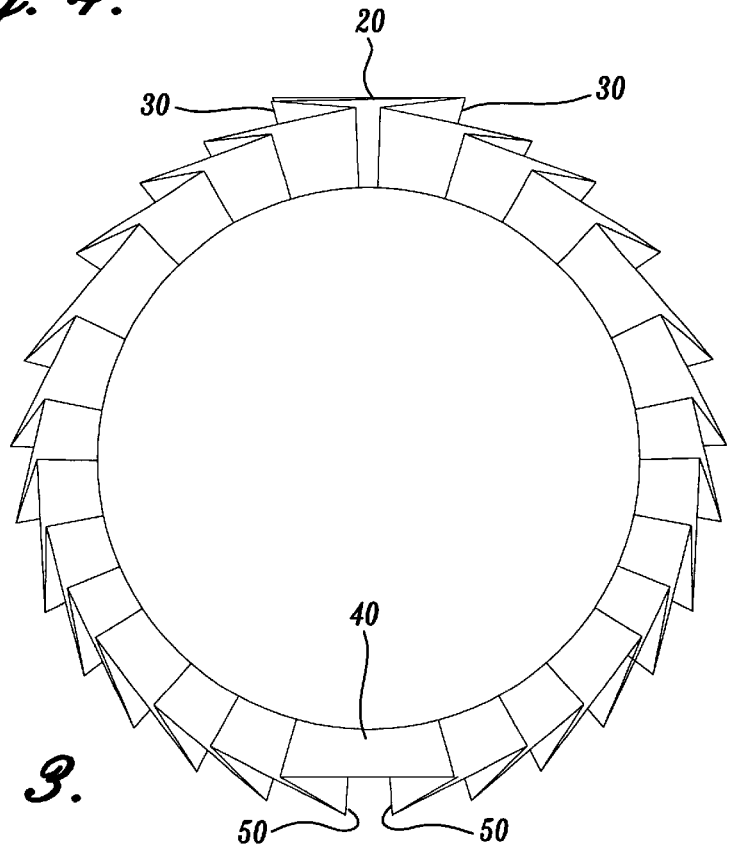
FIG. 3 is a cross-sectional view showing the symmetrical pleat pattern of the pleated kilt according to one embodiment of the present invention taken substantially along lines 3—3 of FIG. 2.

FIG. 3 is a cross-sectional view showing the symmetrical pleat pattern of the pleated kilt according to one embodiment of the present invention taken substantially along lines 3—3 of FIG. 2. The pleat lines of the plurality of right 60 and left 70 pleats extend away from the front center pleat 20 in the direction towards the back center pleat 40. In accordance with one embodiment of the present invention, the plurality of right 60 and left 70 pleats extend away symmetrically from the front center pleat 20 in the direction towards symmetrically the back center pleat 40.

Referring back to FIGS. 1 and 2, the plurality of right 60 and left 70 pleats extend substantially the length of kilt 10 from sweep 170 to waistband edge 160 of waistband 150. From sweep 170, the plurality of right 60 and left 70 pleats taper in the upper portion of kilt 10. In the embodiment shown in FIG. 2, the plurality of right 60 and left 70 pleats taper on the back of kilt 10 at a top stitch to waist line 140 and terminates at the waistband edge 160. As those skilled in the art will appreciate, the plurality of pleats may taper at any point in the upper portion of the backside of kilt 10. FIG. 1 shows that the plurality of right 60 and left 70 pleats taper on the front of kilt 10 at steps 170 which are located at various points below top stitch to waist line 140. Again, it is to be appreciated that the plurality of pleats may taper at any point in the upper portion of the front side of kilt 10.

Kilt 10 further includes at least one pocket for holding various objects therein. As shown in FIGS. 1 and 2, kilt 10 may include a pair of pockets 90. The upper end of pockets 90 are secured to kilt 10 at the upper portions of kilt 10. Pockets 90 may be secured for example, by stitching, buckles, VELCRO, hook and loop fastener or hook and eye. By securing the upper end of pockets 90 to kilt 10, the free movement of the pleats is not impeded substantially (as could occur if the lower portions of pockets 90 were secured to kilt 10) thereby providing the wearer with greater mobility while they are engaged in physical activities, such as walking or running. Further, by having the upper end of pockets 90 secured to kilt 10, objects contained therein will be less likely to fall because pockets 90 will tend to remain in the vertical or upright position relative to the wearer's body position.

In another embodiment of the present invention, pockets 90 have an interior partition or lip 100 formed therein for gripping or holding an object such as a wallet contained in pockets 90 below the partition or lip. Lip 100 may be formed for example, by stitching together the horizontal folds of the cloth of pockets 90. It is to be appreciated that other ways for making a lip may be employed such that an object may be restrained in pockets 90 without departing from the scope of the present invention.

Figure 4:
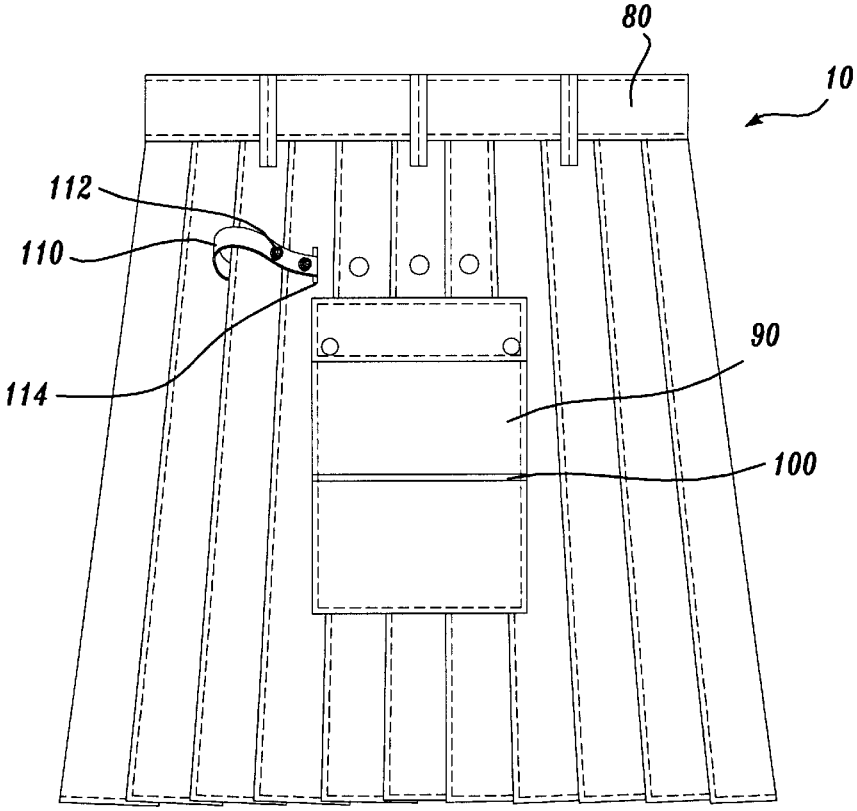
FIG. 4 is a side view showing a symmetrical pleated kilt having a loop according to one embodiment of the present invention.

FIG. 4 is a side view showing a symmetrical pleated kilt 10A having a loop 110 according to one embodiment of the present invention. Loop 110 may have one end attached to kilt 10A and a free end having one or more fasteners 112 for fastening to kilt 10A. By sliding the free end of loop 110 into a slit 114 of kilt 10A, the wearer may variably fasten fasteners 112 to kilt 10A, thereby holding or accommodating objects of varying sizes. In the event that the wearer chooses not to hold or accommodate objects, the free end of loop 110 can be pushed all the way into slit 114 and thus into the interior of kilt 10A so fasteners 112 can be fastened to kilt 10A so that loop 110 is flush with the surface of kilt 10A. Fasteners 112 may comprise for example of, snaps, buttons, rivets, Velcro, and hooks and eyes. The fasteners 112 shown in FIG. 4 are snaps. It is to be appreciated that numerous types of fasteners may be employed such that the free end of loop 110 can be fastened to kilt 10 without departing from the scope of the present invention.

Going back to FIG. 1, kilt 10 can also be worn as a pair of trousers. By bifurcating kilt 10 with fastener 120 into two sections, kilt 10 is converted to a pair of trousers. Fastener 120, as shown in FIG. 1, may include one or more buttons that is sewn or otherwise attached to the backside of kilt 10 and fitted into buttonholes or slits (not shown) on the front side of kilt 10. It is to be appreciated that numerous types of fasteners may be employed such that kilt 10 is bifurcated into two sections without departing from the scope of the present invention.

Figure 5:
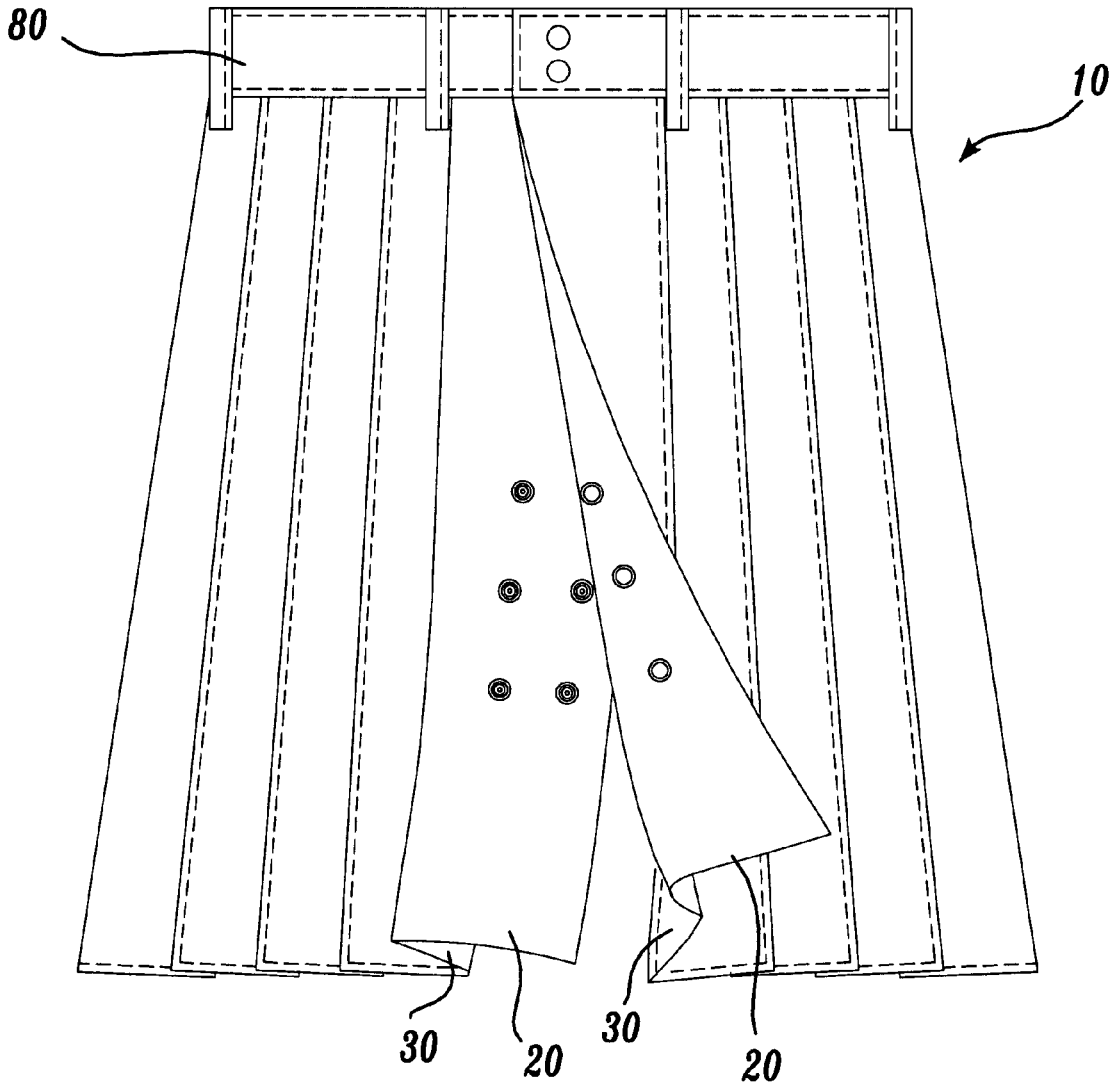
FIG. 5 is a front view showing a symmetrical pleated kilt having a fastener on one side thereof for fastening to the other side according to one embodiment of the present invention.

FIG. 5 is a front view showing a symmetrical pleated kilt having one or more fasteners on one side of kilt 10B for fastening to the other side of kilt 10B according to one embodiment of the present invention. Kilt 10B has an over apron 132 which is the unpleated section on the front side of kilt 10B. Kilt 10B also has an under apron 134 which is also unpleated and fits under the over apron 132. Kilt 10B further has a fastener system 130 for fastening over apron 132 to under apron 134. As those skilled in the art will appreciate, fastener 130 may be comprised of buttons, buckles, snaps, rivets, Velcro, or hooks and eyes, for example. When over apron 132 is fastened over under apron 134, a front center pleat is formed that has two or more outward facing pleat lines 30. Not shown in FIG. 5, kilt 10B also has a back center pleat that has two or more inward facing pleat lines. A plurality of right 60 and left pleats 70 extend from the front center pleat to the back center pleat. In accordance with one embodiment of the present invention, the plurality of right and left pleats extend symmetrically from the front center pleat to the back center pleat.

As shown in FIG. 5, the pleat lines of the plurality of right and left pleats extend away from the front center pleat in the direction towards the back center pleat. In accordance with one embodiment of the present invention, the plurality of right and left pleats extend away symmetrically from the front center pleat and extend symmetrically towards the back center pleat.

The dimensions of one embodiment of the symmetrical pleated kilt before the pleats are formed will now be described in detail with reference to FIGS. 6–11. With reference to these figures, the outside of the kilt is known as the Right Side and is denoted by the letters RS., and the inside of the kilt is known as the Wrong Side and is denoted by the letters WS.

Figure 6:
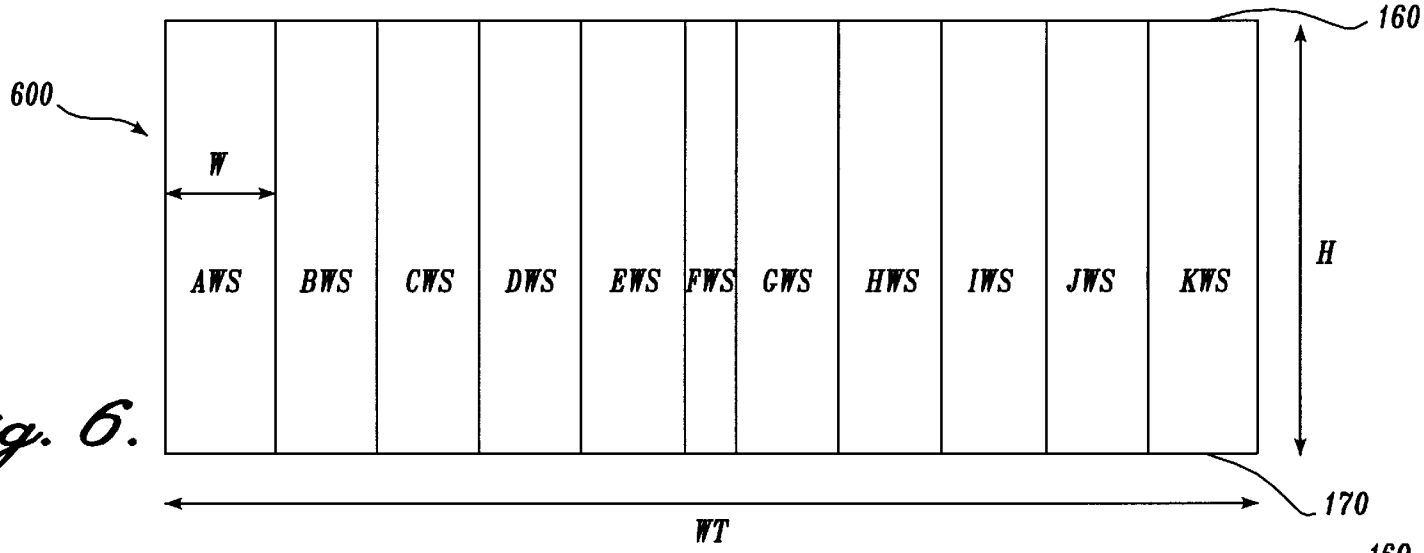
FIG. 6 is a view showing the wrong side of the back side of the symmetrical pleated kilt according to one embodiment of the present invention.

FIG. 6 is a view of a flat pattern subassembly showing the wrong side 600 of the back of the symmetrical pleated kilt according to one embodiment of the present invention. Prior to forming the pleats of the symmetrical pleated kilt, the flat pattern 600 consists of several panels including a center panel FWS and a pair of end panels AWS and KWS. End panels AWS and KWS can have a width of about 5¼ inches each and are sewn to the front panels described below. The width W of end panel AWS is measured from the end edge of the flat pattern 600 across to a width of panel AWS. This width of panel AWS is the total width of the pleat face and the return of panel AWS. The width of end panel KWS is measured in the same way as end panel AWS. Panel BWS can have a width W of about 5 inches and is measured from the return of panel AWS across to the far edge of the return of panel BWS. Panels CWS, DWS, EWS, GWS, HWS, IWS, and JWS are each measured in the same way as panel BWS and each can have a width of about 5 inches. Center panel FWS can have a width of about 3 inches as measured across from the return of panel EWS to the return of panel GWS. The flat pattern 600 can have an overall width WT of about 53½ inches measured from the outer end edges of end panels AWS and KWS and a height H of about 21 inches measured from the sweep 170 to the waistband edge 160.

Figure 7:
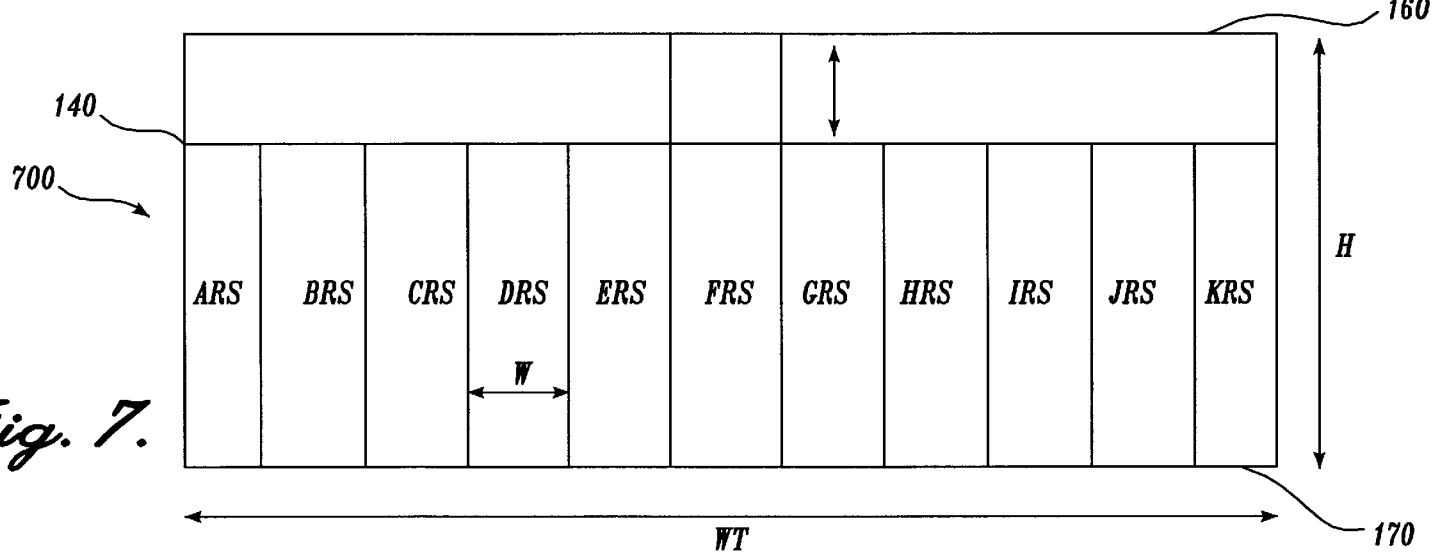
FIG. 7 is a view showing the right side of the back side of the symmetrical pleated kilt according to one embodiment of the present invention.

FIG. 7 shows a flat pattern subassembly from the right side 700 of the back of the symmetrical pleated kilt according to one embodiment of the present invention and prior to forming the pleats of the symmetrical pleated kilt. The subassembly consists of several panels including a center panel FRS and a pair of end panels ARS and KRS. End panels ARS and KRS can have a width of about 3¾ inches each. The width of end panel ARS is measured from the end edge of the flat pattern 700 across to the pleat face of end panel ARS. The width of end panel KRS is measured in the same corresponding way as end panel ARS. Panel BRS can have a width of about 5 inches and is measured from the distal edge of the pleat face of panel ARS across to the distal edge of the pleat face of panel BRS. Panels CRS, DRS, ERS, GRS, HRS, IRS, and JRS are measured in the same way as panel BRS and each can have a width of about 5 inches. Center panel FRS can have a width of about 6 inches and is measured from the pleat face of panel ERS across to the pleat face of panel GRS. The flat pattern 700 can have an overall width WT of about 53½ inches measured from the ends of end panels ARS and KRS and a height H of about 21 inches measured from the sweep 170 to the waistband edge 160 The flat pattern 700 can have a height H1 of about 5½ inches measured from the top stitch to waist line 140 to the waistband edge 160.

Figure 8:
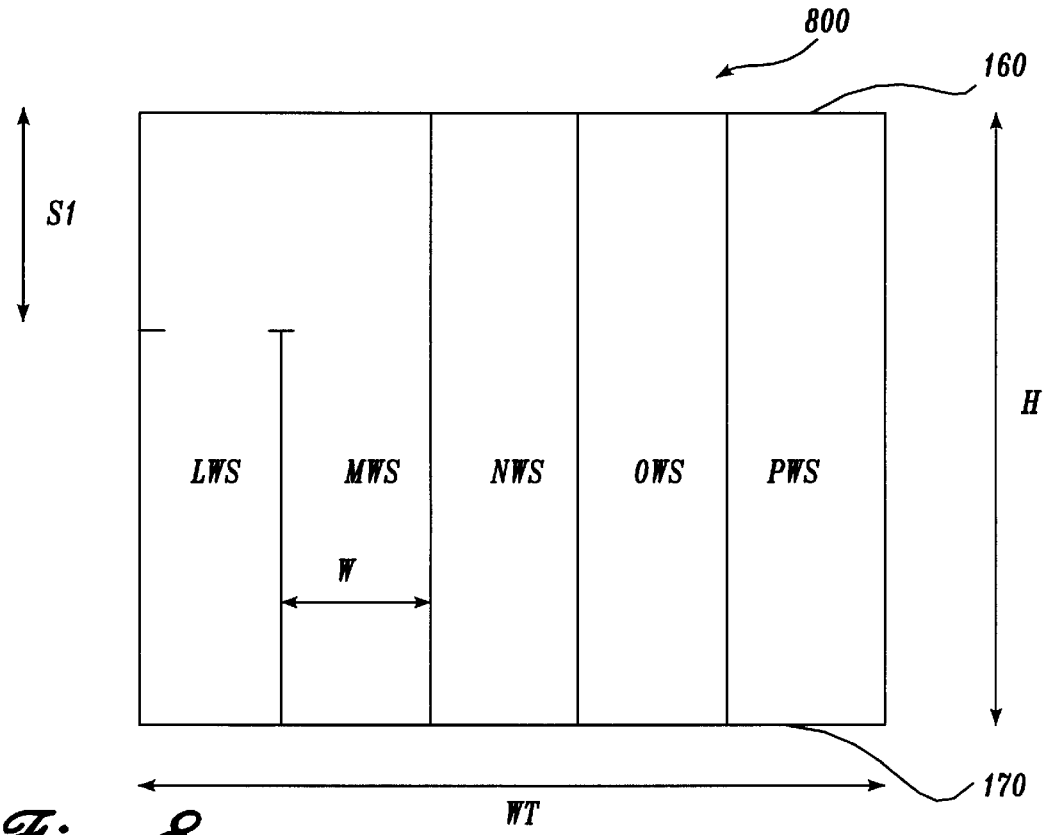
FIG. 8 is a view showing the wrong side of the front right panel of the symmetrical pleated kilt according to one embodiment of the present invention.

FIG. 8 is a view of a flat pattern subassembly showing the wrong side 800 of the front right panel of the symmetrical pleated kilt according to one embodiment of the present invention prior to forming the pleats of the symmetrical pleated kilt. The flat pattern 800 consists of several panels including a pair of end panels LWS and PWS. End panel LWS can have a width of about 4¾ inches and is measured from the end edge of flat pattern 800 across the width of panel LWS. This width of panel LWS is the total width of the pleat face and the return of panel LWS. End panel PWS can have a width of about 5¼ inches and is measured from the end edge of flat pattern 800 across the width of panel PWS. This width of panel PWS is the total width of the pleat face and the return of panel PWS. Panel MWS can have a width of about 5 inches and is measured from the end edge of panel LWS across the width of panel MWS. This width of panel MWS is the total width of the pleat face and the return of panel MWS. Panels NWS and OWS are each measured in the same way as panel MWS and each can have a width of about 5 inches. The flat pattern 800 can have an overall width WT of about 25 inches measured from the ends of end panels LWS and PWS and a height H of about 21 inches measured from the sweep 170 to the waistband edge 160.

Panels LWS and MWS taper along step S1, the distance of which can be about 8 inches from the waistband edge 160.

Figure 9:
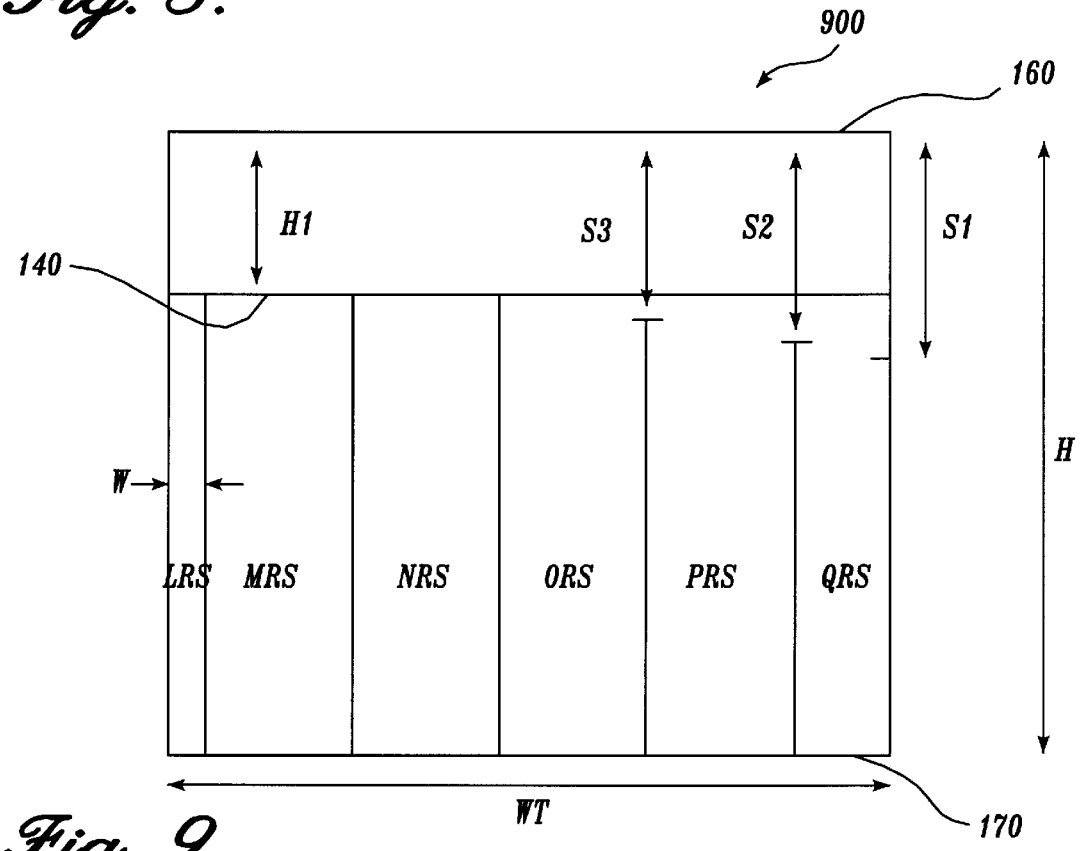
FIG. 9 is a view showing the right side of the front right panel of the symmetrical pleated kilt according to one embodiment of the present invention.

FIG. 9 is a view of a flat pattern subassembly showing the right side 900 of the front right panel of the symmetrical pleated kilt according to one embodiment of the present invention, prior to forming the pleats of the symmetrical pleated kilt. The flat pattern 900 consists of several panels including a pair of end panels LRS and QRS. End panel LRS can have a width of about 1¾ inches and is measured from the end edge of flat pattern 900 across the width of panel LRS. This width of panel LWS is the total width of the return of panel MRS. End panel QRS can have a width of about 3⅛ inches and is measured from the end edge of flat pattern 900 across the panel QRS. This width of panel QRS is the width of the pleat face of panel QRS. Panel PRS can have a width of about 5 inches and is measured from the adjacent edge of the pleat face of panel QRS across to the pleat face of panel PRS. Panels ORS, NRS, and MRS are each measured in the same way as panel PRS and each can have a width of about 5 inches. The flat pattern 900 can have an overall width WT of about 25 inches measured from the ends of end panels LRS and QRS and a height H of about 21 inches measured from the sweep 170 to the waistband edge 160. Panels LRS, MRS, NRS, and ORS taper at a top stitch to waist line 140 which can be a distance of about 5½ inches from the waistband edge 160, or height H1. Panels PRS and QRS taper at steps S3 and S2, respectively, and can be a distance of about 6¼ inches and 7 inches, respectively, from the waistband edge 160.

Figure 10:
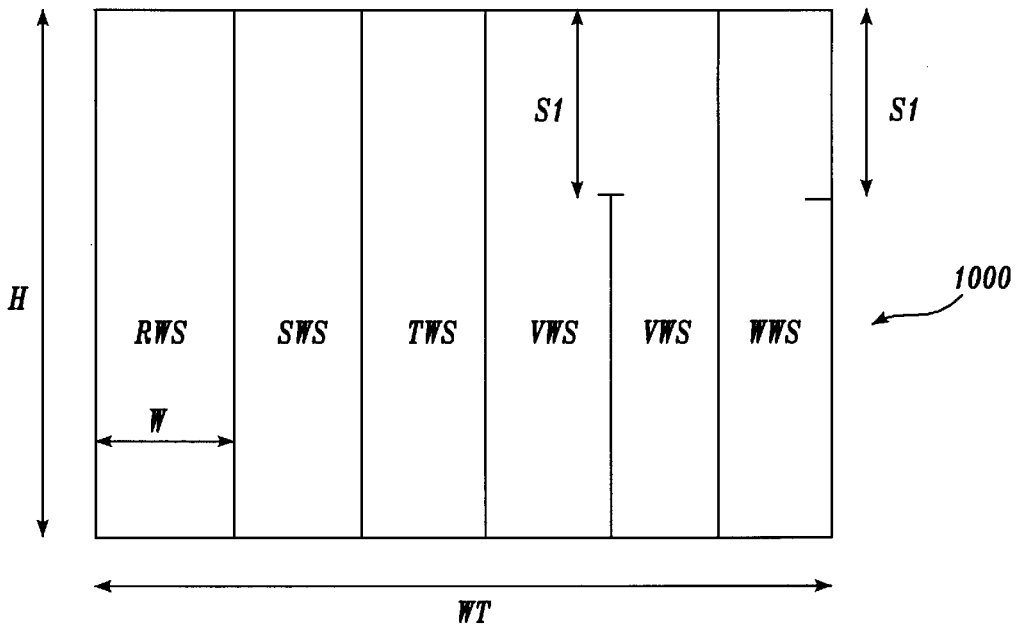
FIG. 10 is a view showing the wrong side of the front left panel of the symmetrical pleated kilt according to one embodiment of the present invention.

FIG. 10 is a view of a flat pattern subassembly showing the wrong side 1000 of the front left panel of the symmetrical pleated kilt according to one embodiment of the present invention, prior to forming the pleats of the symmetrical pleated kilt. The flat pattern 1000 consists of several panels including a pair of end panels RWS and WWS. End panels RWS and WWS may have a width of about 5¼ inches and 3⅞ inches, respectively. End panel RWS is measured from the end edge of flat pattern 1000 across the width of panel RWS. This width of panel RWS is the total width of the pleat face and return of panel RWS. End panel WWS is measured from the end edge of flat pattern 1000 across the total width of panel WWS. Panel VWS can have a width of about 4¼ inches and is measured across the total width of panel WWS to the return of VWS. Panel UWS can have a width of about 5 inches and is measured from the return of panel VWS to the return of panel UWS. Panels SWS and TWS, can have a width of about 5 inches and is measured in the same way as panel UWS. The flat pattern 1000 has an overall width WT of about 29 inches measured from the far end edges of end panels RWS and WWS and a height H of about 21 inches measured from the sweep 170 to the waistband edge 160. Panels UWS, VWS, and WWS can taper beginning at a location of about 7½ inches from the waistband edge 160.

Figure 11:
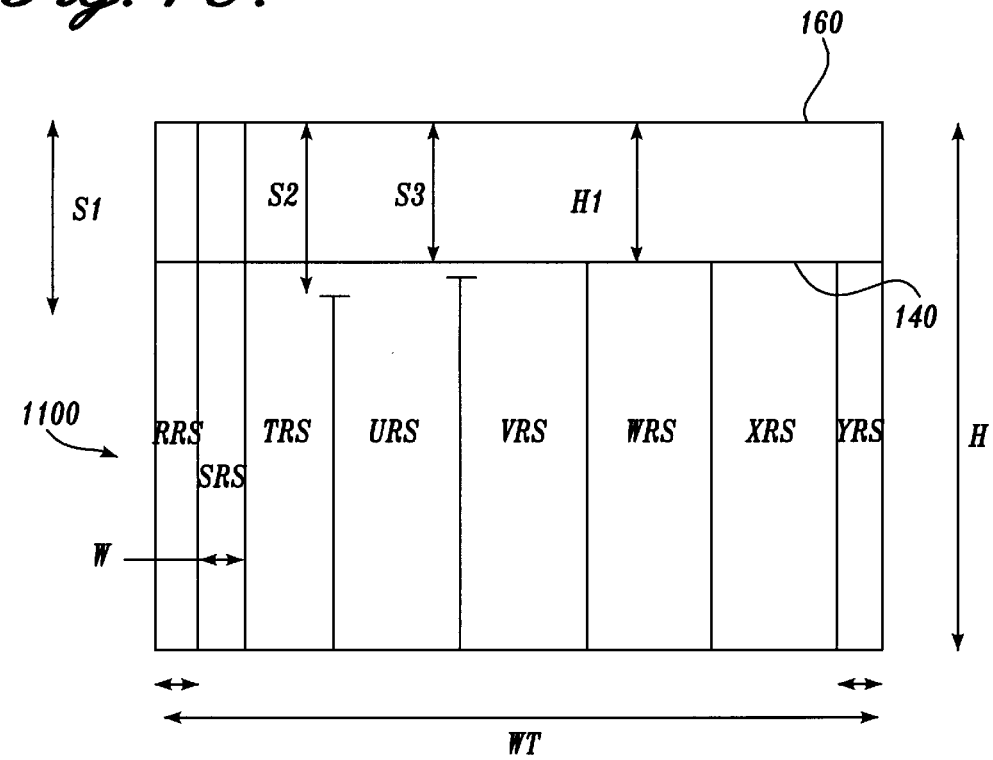
FIG. 11 is a view showing the right side of the front left panel of the symmetrical pleated kilt according to one embodiment of the present invention.

FIG. 11 is a view of a flat pattern subassembly showing the right side of the front left panel of the symmetrical pleated kilt according to one embodiment of the present invention, prior to forming the pleats of the symmetrical pleated kilt. The flat pattern 1100 consists of several panels including a center panel SRS and a pair of end panels RRS and YRS. End panel RRS can have a width of about 1¾ inches and is measured from the end edge of flat pattern 1100 across the width of panel RRS. This width of panel RRS is the width of the return of panel SRS. End panel YRS can have a width of about 1¾ inches and is measured from the end edge of flat pattern 1100 across the width of panel YRS. This width of panel YRS is the width of the return of panel XRS. Center panel SRS may have a total width of about 2 inches. Panel TRS may have a width of about 3½ inches and is measured from the return of panel SRS to the pleat face of TRS. Panel URS may have a width of about 5 inches and is measured from the pleat face of panel TRS to the pleat face of panel URS. Panels VRS, WRS and XRS may have a width of about 5 inches and are measured in the same way as panel URS.

Panels VRS, WRS, XRS, and YRS taper at a top stitch to waist line 140 which can be about 5½ inches from the waistband edge 160, or height H1. Panels RRS, SRS, TRS, and URS taper at steps S1, S1, S2, and S3, respectively, and can be a distance of about 8 inches, 8 inches, 7 inches, and 6¼ inches, respectively, from waistband edge 160.

The flat pattern 1100 may have an overall width of about 29 inches measured from the end edges of end panels RRS and YRS and a height H of about 21 inches measured from the sweep 170 to the waistband edge 160.

While preferred embodiments of the invention have been illustrated and described, it will be appreciated that various changes can be made therein without departing from the spirit and scope of the invention.

The embodiments of the invention in which an exclusive property or privilege is claimed are defined as follows:

1. A pleated garment comprising:

a front center pleat having at least two outward facing pleat lines;

a back center pleat having at least two inward facing pleat lines; and a plurality of right and left pleats extending substantially from said front center pleat to said back center pleat.

2. The pleated garment of claim 1 wherein the pleat lines of said plurality of right and left pleats extend away from said front center pleat and continue towards said back center pleat.

3. The pleated garment of claim 1 wherein said plurality of right and left pleats extend substantially the length of said pleated garment and taper in the upper portion thereof.

4. The pleated garment of claim 1 wherein said front center pleat has a pleat face width of about 2 inches and a return of about 1⅛ inches on one side thereof and ¾ inch on the other side thereof.

5. The pleated garment of claim 1 wherein the width from said at least two inward facing pleat lines of said back center pleat is about 6 inches.

6. The pleated garment of claim 1 wherein the width of the pleat face of one of said plurality of right and left pleats is about 3½ inches and the return is about 1½ inches.

7. The pleated garment of claim 1 further comprising at least one pocket, an upper end of said at least one pocket secured to said pleated garment at upper portions of said pleated garment.

8. The pleated garment of claim 7 wherein said at least one pocket has a lip formed therein for gripping an object contained in said at least one pocket.

9. The pleated garment of claim 1 further comprising a loop, one end of said loop attached to said pleated garment, the other end of said loop for sliding into a slit on said pleated garment, said other end having a first fastener system for variably fastening said loop to said pleated garment thereby holding objects of varying sizes therewith.

10. The pleated garment of claim 9 wherein said first fastener system comprises snaps, buttons, rivets, hook and loop fasteners, and hook and eye.

11. The pleated garment of claim 1 further comprising at least one fastener for bifurcating said pleated garment into two sections.

12. A pleated garment having a second fastener system on one side thereof for fastening to the other side of said pleated garment, said pleated garment comprising:

a front center pleat having at least two outward facing pleat lines;

a back center pleat having at least two inward facing pleat lines; and a plurality of right and left pleats extending substantially from said front center pleat to said back center pleat.

13. The pleated garment of claim 12 wherein the pleat lines of said plurality of right and left pleats extend away from said front center pleat in the direction towards said back center pleat.

14. The pleated garment of claim 12 wherein said second fastener system comprises snaps, buttons, rivets, hook and loop fasteners, and hook and eye.

15. A method of making a skirt comprising the steps of:

providing a front center pleat having at least two outward facing pleat lines;

providing a back center pleat having at least two inward facing pleat lines;

folding a portion of fabric material to provide a plurality of right and left pleats, said right and left pleats extending substantially from said front center pleat to said back center pleat and further extending substantially the length of the fabric material; and tapering said right and left pleats in the upper portion thereof on approach to the upper edge of said fabric material.

16. The method of claim 15 wherein the pleat lines of said plurality of right and left pleats extend away from said front center pleat in the direction towards said back center pleat.

* * * * *